United States Patent [19]

Langowski

[11] 3,937,515

[45] Feb. 10, 1976

[54] HEAD FOR PIPE RACKERS

[75] Inventor: Faustyn C. Langowski, Houston, Tex.

[73] Assignee: Byron Jackson Inc., Long Beach, Calif.

[22] Filed: Nov. 22, 1974

[21] Appl. No.: 526,206

[52] U.S. Cl. ..... 294/88; 214/2.5; 294/90; 294/104

[51] Int. Cl.[2] ..... E21B 19/14

[58] Field of Search ..... 294/104, 90, 86, 33, 88; 214/2.5, 1 P, DIG. 3

[56] References Cited

UNITED STATES PATENTS

| | | | |
|---|---|---|---|
| 1,295,439 | 2/1919 | Coveney | 294/90 |
| 3,561,811 | 2/1971 | Turner, Jr. | 294/90 |
| 3,655,071 | 4/1972 | Langowski et al. | 214/2.5 |

*Primary Examiner*—Frank E. Werner
*Attorney, Agent, or Firm*—John O. Evans, Jr.

[57] ABSTRACT

A head for use in a well pipe racking system has a support plate for drill collars and a slide shiftable to and from positions for supporting drill pipe. A retaining lever is pivoted for movement between a position for retaining the drill collars and drill pipe in the head and an open position. The lever is reversible to swing to opposite sides of the head.

6 Claims, 4 Drawing Figures

HEAD FOR PIPE RACKERS

BACKGROUND OF THE INVENTION

In the drilling of wells, such as oil and gas wells, it is desirable to rack the stands of drill pipe and drill collars in racking means in the derrick or beneath the floor of the derrick. Such racking apparatus necessitates the movement of successive pipe stands between racked positions and a position at the center of the derrick, and the pipe must be transferred between such positions by suitable supporting means engageable beneath the usual shoulder provided by the tool joint or coupling end of the pipe.

To conserve space in the rack, the pipe is racked in close, side by side relation in sequence, by pipe lifting and positioning means such as that disclosed in U.S. Pat. No. 3,561,811, granted Feb. 9, 1971, or in the companion application for U.S. Pat. Ser. No. 526,207, filed Nov. 22, 1974. In either case, the pipe is supported in a head which engages beneath the upset or shoulder of the tool joint to support the pipe and move it during the racking and unracking operations. A claw or retaining arm is operable to confine the pipe within the head and is pivotable to an open position to one side of the head to release the pipe. However, as the head is shifted laterally in the derrick to move pipe to and from racked positions, the claw or retaining arm precludes close racking of the pipe on one side, that is the side on which the claw or arm swings to the open position, because the claw or arm limits the proximity of the head to an adjacent pipe.

Accordingly, it has been the practice in the use of the pipe racking apparatus of the type disclosed in the above identified Pat. No. 3,561,811, either to rack pipe in widely spaced relation or to change lifting heads, depending on the direction in which the pipe is being racked, one head having a claw opening to one side and the other head having a claw opening to the other side.

SUMMARY OF THE INVENTION

The present invention provides a pipe supporting or lifting head for use in racking well pipe, including drill pipe and heavier drill collars, in which the claw or arm does not interfere with racking the pipe in closely adjacent vertical relation.

More particularly, the head of the present invention has a pipe retaining claw or lever arm which is pivotally mounted in a central location of the head, so as to be reversible to swing to either side of the head. The actuator cylinder for shifting the claw or arm between the open and closed positions is pivotally mounted on the center of the head so as to be connectable with the claw or arm in its alternate positions.

In order to enable the head to support either drill pipe or larger drill collars, the head has a plate providing a recess or seat for drill pipe and another plate providing a recess or plate for receiving drill collars, the drill pipe receiving plate being shiftable from a retracted position to a drill pipe supporting position.

In accordance with the invention, there is provided a pipe supporting head for well pipe racking apparatus including a body having side walls, means providing a pipe-receiving aperture between said side walls and open at one end of said body, arcuate, pipe-supporting means carried by said body at the inner end of said aperture, a claw member, first pivot means mounting said claw member on said body for pivotal movements between an open position, in which said claw member is retracted from said aperture to permit a pipe to enter said aperture and be supported by said pipe-supporting means, and a closed position, in which said claw member engages a pipe supported by said pipe-supporting means to retain the pipe within said aperture, a portion of said claw member projecting laterally outside of one only of said side walls, extensible and contractible actuator means for pivoting said claw member between said positions, said actuator means including second pivot means connecting one end of said actuator means to said body, and third pivot means connecting the other end of said actuator means to said claw member at a location offset from said first pivot means, said pipe-supporting means, said first pivot means and said second pivot means being aligned longitudinally of said body and centrally of said side walls, said claw member and said actuator means being selectively arrangeable in said body to enable said claw member to pivot on said first pivot means from said open position to said closed position in a given sense, and, optionally, in the opposite sense.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principles of the invention; but it is to be understood that such detailed descriptions are not to be taken in a limiting sense, since the scope of the invention is best defined by the appended claims.

DESCRIPTION OF THE PREFERRED EMBODIMENT

Figure 1:
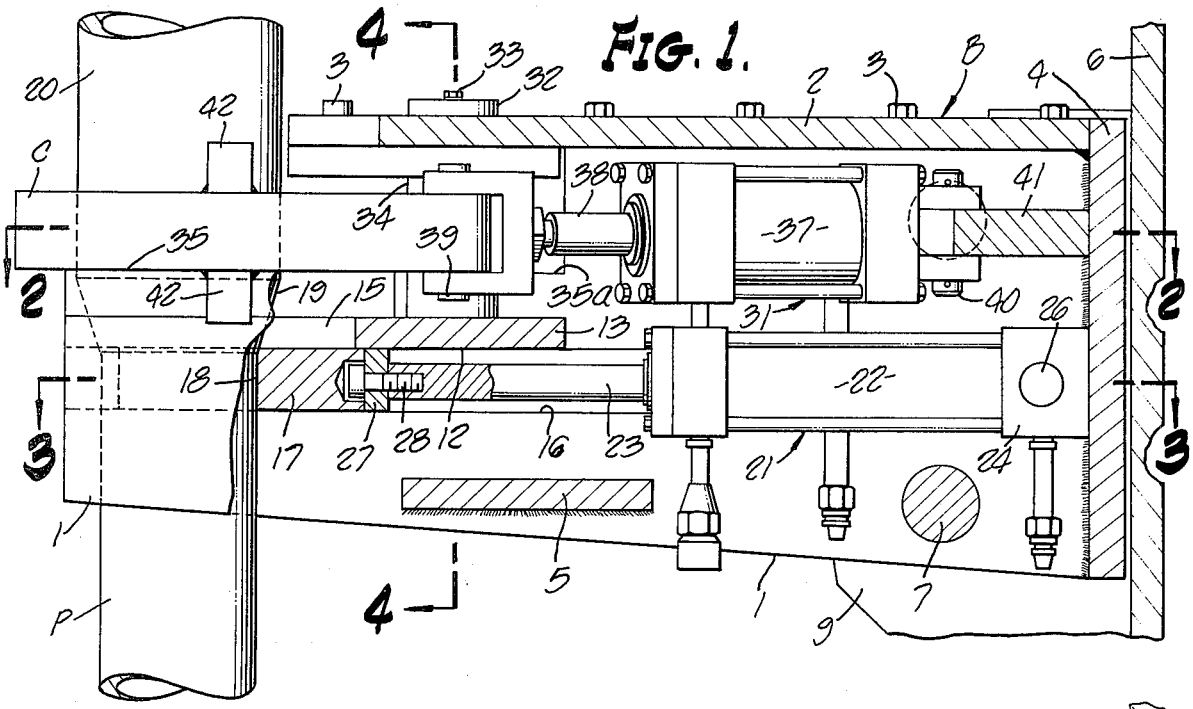
FIG. 1 is a view partly in vertical section, with parts shown in elevation, showing a pipe racker head embodying the invention.

As seen in the drawings, the racker head of the present invention comprises a body structure B having side walls 1 to which a top wall 2 is removably secured by fasteners 3. An end wall 4 is welded or otherwise secured between the side walls 1 to provide rigidity, and a cross brace 5 may also be welded between the side walls 1. In order to support the head on a support structure, such as a positioning arm or lifting assembly 6, adapted to move the head during pipe racking operations, the body B has a transverse pin 7 extending through the side walls 1 and engageable in slots 8 in supporting brackets 9 of the support structure 6. Retainers 10 are secured to the brackets 9 by fasteners 11 to hold the pin 7 in place. Within the body B, the side walls 1 have horizontal shoulders 12 on which a drill collar support plate 13 is secured by fasteners 14. This plate 13 has an arcuate recess defined by an arcuate wall 15, adapted to receive a drill collar and support the drill collar on the edge of the wall 15, at the enlarged joint end of the drill collar. The plate 13 can be replaced by plates adapted to support a range of drill collar sizes, as is well known.

Figure 3:
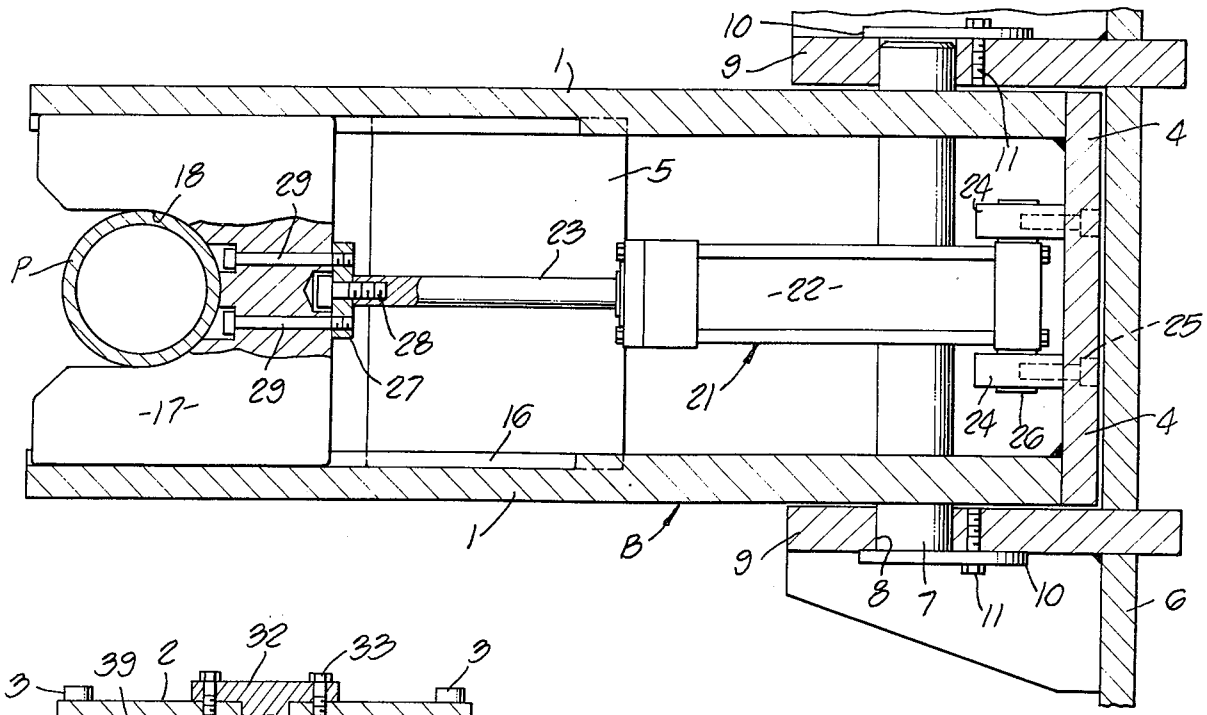
FIG. 3 is a horizontal section, as taken on the line 3—3 of FIG. 1, with parts shown in elevation.

The side walls 1 are also provided with horizontal slots or grooves 16 for receiving a slide plate 17 which is adapted to support a drill pipe when extended, as shown. The slide plate 17 is also retractable to allow a drill collar to be supported by the plate 13. As best seen in FIG. 1, the slide plate 17 has a recess defined by an arcuate wall 18 for receiving a drill pipe P and supporting the pipe on a shoulder 19 of a tool joint box 20. As best seen in FIG. 3, the slide plate 17 is removably secured to actuator means 21 for reciprocating the plate 17 between retracted and projected positions. The actuator means 21, as shown, is in the form of a double acting fluid pressure operated actuator cylinder 22 having a rod 23. The cylinder 22 is connected to the body end wall 4 by ears 24 secured to the end wall 4 by fasteners 25, the ears receiving support pins 26 on the end of the cylinder 22. The actuator rod 23 is connected to the slide plate 17 by means of a connector plate 27 fastened by a screw 28 to the rod 23, the plate being fastened to the slide 17 by screws 29, so that plates having different sizes of pipe receiving recesses can be installed in the head.

Figure 2:
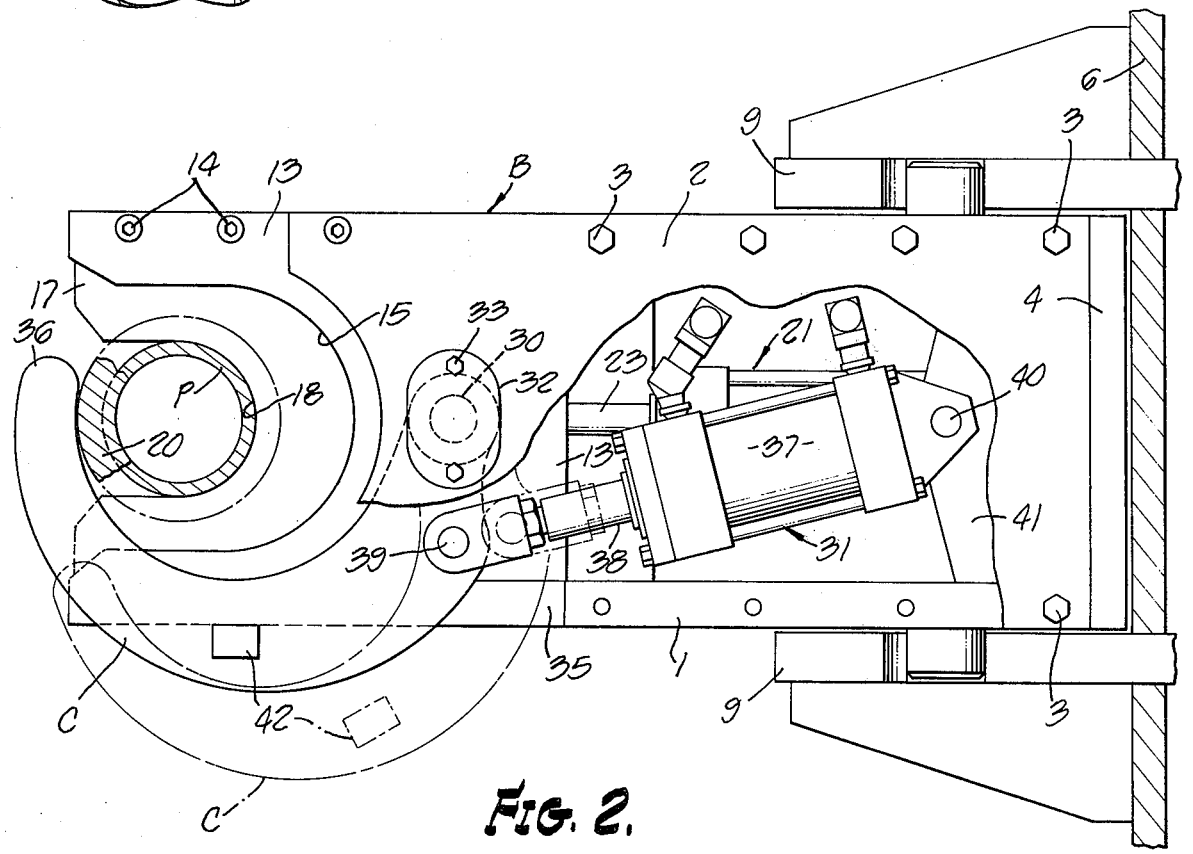
FIG. 2 is a top plan of the head of FIG. 1 with parts broken away on the line 2—2 of FIG. 1, and showing in full lines the claw closed on a drill pipe, the claw being shown in broken lines in the open position.

In order to retain the pipe P in the head, an arcuate claw or arm C is mounted on a pivot pin 30 and is actuatable by actuator means 31 between the closed position and the open position, respectively shown in full lines and broken lines in FIG. 2. The pivot pin 30 has a head 32 by which the pin is removably connected to the top wall 2 of the body B by fasteners 33, and the shank of the pin 30 extends downwardly into the plate 13. The claw C has a mounting portion 34 pivoted on the pin 30 and extends arcuately outwardly through a slot 35 in a side wall of the body, so that the free end 36 of the claw is adapted to move from the retracted position, shown in broken lines in FIG. 2 to the closed position, shown in full lines, at which the pipe P is confined in the pipe opening defined by the arcuate wall 18.

Figure 4:
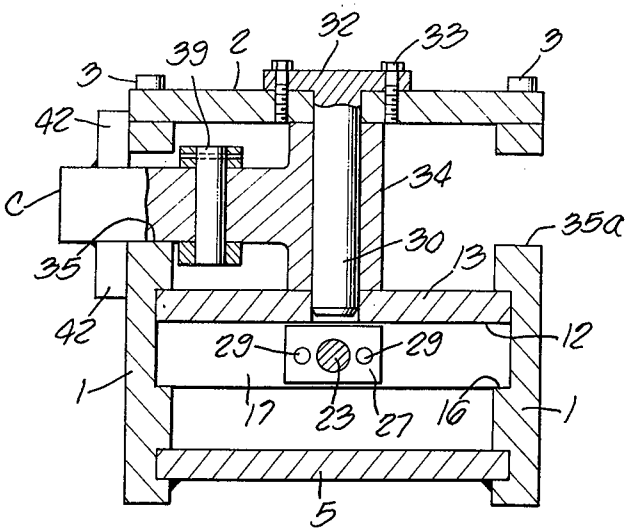
FIG. 4 is a vertical section, as taken on the line 4—4 of FIG. 1, showing the reversible pivot for the claw.

The actuator means 31 for moving the claw between its opened and closed positions is a double acting, fluid pressure operated actuator cylinder 37 having a rod 38 pivotally connected by a pin 39 to the claw C in spaced relation to the claw pivot pin 30. The cylinder 37 is pivotally anchored by a pin 40 to a plate 41 mounted between the side walls of the body. Closing movement of the claw C is limited by stop lugs 42 welded on the claw and engageable with the side wall 1, as seen in FIG. 4.

From the foregoing, it is apparent that the head is adapted, in use, to receive a pipe, either drill pipe or larger drill collar, and support the pipe on either the support plate 13 or the slide plate 17, and the pipe is confined by the claw C, until the claw is pivoted to its open position. In its open position the claw projects outwardly to one side of the body and constitutes an obstruction which would limit the space between racked pipe. However, the claw C is pivoted at the center of the body as is the actuator cylinder 37. Accordingly, the claw is reversible upon removal of the pivot pin 30 and the actuator connecting pin 39 and the body has a slot 35*a* in its side wall opposite the slot 35 to accommodate the claw C in its alternate position.

While the head has been described above as being constructed to enable reversal of the claw or arm C, it will be understood that left and right hand heads can be made up of the corresponding components, but with the claws installed in opposite directions on the pivot pin 30. Moreover, it will be noted that since the rod 38 of the actuator cylinder 37 is connected intermediate the ends of the claw C, the claw is pushed forcibly to the closed position by pressure applied to the full cross sectional area of the piston of the actuator cylinder, and the claw is quickly opened by application of fluid to the smaller volume rod end, through the usual fluid connections.

I claim:

1. A pipe-supporting head for well pipe racking apparatus comprising: a body having side walls, means providing a pipe-receiving aperture between said side walls and open at one end of said body, arcuate, pipe-supporting means carried by said body at the inner end of said aperture, a claw member, first pivot means mounting said claw member on said body for pivotal movements between an open position, in which said claw member is retracted from said aperture to permit a pipe to enter said aperture and be supported by said pipe-supporting means, and a closed position, in which said claw member engages a pipe supported by said pipe-supporting means to retain the pipe within said aperture, a portion of said claw member projecting laterally outside of one only of said side walls, extensible and contractible actuator means for pivoting said claw member between said positions, said actuator means including second pivot means connecting one end of said actuator means to said body, and third pivot means connecting the other end of said actuator means to said claw member at a location offset from said first pivot means, said pipe-supporting means, said first pivot means and said second pivot means being aligned longitudinally of said body and centrally of said side walls, said claw member and said actuator means being selectively arrangeable in said body to enable said claw member to pivot on said first pivot means from said open position to said closed position in a given sense, and, optionally, in the opposite sense.

2. A pipe-supporting head as defined in claim 1, wherein said first pivot means comprises a pivot pin and means mounting said claw member on said pivot pin, and including means for removably mounting said pivot pin on said body.

3. A pipe-supporting head as defined in claim 1, wherein said actuator means comprises a double-acting, fluid pressure operated actuator cylinder means.

4. A pipe-supporting head as defined in claim 3, wherein said cylinder means has a cylinder element comprising said one end of said actuator means and a rod element comprising said other end of said actuator means, and said third pivot means is adapted to removably connect said rod element to said claw member.

5. A pipe-supporting head as defined in claim 1, wherein said side walls are provided, respectively, with elongated slots enabling said claw member to project through a respective slot.

6. A pipe supporting head as defined in claim 1, wherein said pipe supporting means has a support plate secured to said body and having a pipe receiving arcuate opening defined by a pipe supporting edge of said plate, and a slide plate in said body and also having a pipe receiving arcuate opening defined by a pipe supporting edge of said slide plate, and actuator means for shifting said slide plate between a retracted position beneath said support plate and an extended position projecting past said support plate, whereby said plates are selectively operable to support a pipe confined in one of said pipe receiving openings by said claw member.

* * * * *